US008419086B2

(12) United States Patent
Moon

(10) Patent No.: US 8,419,086 B2
(45) Date of Patent: Apr. 16, 2013

(54) MORTISE LATCHSET WITH DUALLY BIASED CAM ASSEMBLY

(75) Inventor: Charles W. Moon, Colorado Springs, CO (US)

(73) Assignee: Townsteel, Inc., City of Industry, CA (US)

( * ) Notice: Subject to any disclaimer, the term of this patent is extended or adjusted under 35 U.S.C. 154(b) by 238 days.

(21) Appl. No.: 12/835,876

(22) Filed: Jul. 14, 2010

(65) Prior Publication Data

US 2012/0013135 A1 Jan. 19, 2012

(51) Int. Cl.

| | |
|---|---|
| ***E05C 1/12*** | (2006.01) |
| ***E05C 1/02*** | (2006.01) |
| ***E05C 1/06*** | (2006.01) |
| ***E05C 19/10*** | (2006.01) |
| ***E05C 5/00*** | (2006.01) |

(52) U.S. Cl.

USPC ..... 292/165; 292/137; 292/157; 292/108; 292/111

(58) Field of Classification Search ..... 292/137, 292/157, 159, 161, 163, 165, 170, 169; 70/108, 70/109, 110, 111

See application file for complete search history.

(56) References Cited

U.S. PATENT DOCUMENTS

| | | | | | |
|---|---|---|---|---|---|
| 3,672,714 | A | * | 6/1972 | Schultz | 292/34 |
| 4,071,270 | A | | 1/1978 | Alexander | |
| 4,093,284 | A | * | 6/1978 | Yulkowski | 292/216 |
| 4,118,056 | A | * | 10/1978 | Alexander | 292/169.17 |
| 4,389,061 | A | * | 6/1983 | Foshee | 292/169.14 |
| 4,589,691 | A | | 5/1986 | Foshee et al. | |
| 4,667,376 | A | * | 5/1987 | Ishii et al. | 24/421 |
| 5,265,924 | A | * | 11/1993 | Kim | 292/336.3 |
| 5,813,255 | A | * | 9/1998 | Tell et al. | 70/107 |
| 5,820,177 | A | * | 10/1998 | Moon | 292/335 |
| 5,992,195 | A | * | 11/1999 | Huang et al. | 70/472 |
| 6,393,878 | B1 | * | 5/2002 | Fayngersh et al. | 70/107 |
| 7,003,990 | B2 | * | 2/2006 | Iliuk | 70/107 |
| 7,249,477 | B2 | * | 7/2007 | Toloday et al. | 70/279.1 |

OTHER PUBLICATIONS

Charles W. Moon et al., Unpublished U.S. Appl. No. 12/289,804, filed Nov. 5, 2008.

* cited by examiner

*Primary Examiner* — Thomas Beach
*Assistant Examiner* — Nathan Cumar
(74) *Attorney, Agent, or Firm* — Eric W. Cernyar, P.C.

(57) ABSTRACT

A mortise latchset has an improved leveraged cam assembly, completely internal to the latchset body, versatile enough to allow the door handles to be rotated in either direction to retract the latchbolt, and robust enough to independently bias each of two lever-type door handles toward a handle-centering position, even when one of the handles is being operated. The mortise latchset uses a pair of coaxially mounted cam followers independently leveraged by a cantilevered spring assembly. The cam followers are located between the operating cams and the latch retracting assembly, and each leveraged cam follower is operable to engage the latch retracting assembly to retract the latchbolt, while the other cam follower biases its operating cam in the handle-centering position.

20 Claims, 17 Drawing Sheets

MORTISE LATCHSET WITH DUALLY BIASED CAM ASSEMBLY

FIELD OF THE INVENTION

This invention relates generally to door latching assemblies, and more specifically, to mortise latching assemblies.

BACKGROUND OF THE INVENTION

Mortise latchsets (more commonly referred to as "mortise locksets") are a type of door latching assembly that fits into a rectangular cavity, called a "mortise," that is cut into the side of a door. Mortise latchsets typically comprise a rectangular mortise latchset body that is inserted into the mortise, latchset trim (including inside and outside trim plates, doorknobs, and/or door handles), a strike plate or box keep that lines a cavity in the door jamb, and a keyed cylinder that operates the locking/unlocking function. A mortise latchset includes a typically self-latching main bolt or latchbolt, and optionally may also include a deadbolt and/or guardbolt. The mortise latchset body typically comprises a case assembly and cover that house the keyed cylinder and several levers, springs, and other moving parts used to bias, extend and/or retract the various bolts.

In a typical installation, it is preferred that only the outside door handle be access-controlled. The inside door handle should be free to operate the latch-retracting works inside the mortise latchset body. Accordingly, the latch-retracting works inside some latch assembly bodies includes two independently spindle-operable hubs, both of which are coupled to a latch-retracting works, but only one of which can be locked to prevent access.

Mortise latchsets are also frequently coupled with lever-type handles. A lever-type handle is a handle that, in the default position, extends preferentially to one side horizontally from and away from the handle's axis of rotation. In contrast to a typical rounded door knob, a lever-type handle has a center of gravity displaced a substantial radial distance from its axis, exerting torque on the corresponding hub and the latch-retracting works.

To compensate for the moment of the lever handle, some mortise latchsets provide a stiff spring assembly, housed inside the mortise latchset body, to bias the hub toward the default, non-latch-retracting position. However, to prevent the spring force from biasing the hub past the default, non-latch-retracting position, many latchsets include a stop means that prevents the hub from rotating past that position. Consequently, with such latchsets the lever can only be rotated down, but not also up, to retract the latch.

For example, U.S. Pat. No. 4,071,270 to Alexander illustrates a mortise lockset that includes a compression spring 90 pushing against a lower arm 70 of the outer hub 60. The compression spring 90 resists rotation of the outer hub 60 in a counterclockwise direction, and biases an attached outer lever handle to a horizontal, inactive position. To prevent the spring 90 from pushing the hub 60 clockwise past its inactive, non-latch retracting position, an upper arm 70 of the outer hub 60 engages an abutment 38 on the mortise case. Consequently, the lever 14 can only be rotated downward from its inactive, non-latch retracting position, in order to retract the latch.

As another example, U.S. Pat. No. 4,589,691 to Foshee et al. illustrates a mortise lockset with a pair of torsional hub springs 94 that bias corresponding bias arms 86*a* and 86*b* against corresponding camming surfaces 84 of the inner and outer hubs 46, 48. A stop pin 104 in close proximity to cam faces 70 of the hubs prevents the hubs from rotating past their inactive, non-latch retracting positions. Consequently, the door handle levers 16 and 18 can only be rotated downward from their inactive, non-latch retracting positions, to retract the latch.

Other mortise locksets include a spring-biased lever in the principle latch retractor assembly. One such configuration is illustrated in the prior art lockset illustrated in the background section of pending U.S. patent application Ser. No. 12/424,091, filed on Apr. 15, 2009, for a "Mortise Lock Assembly," which is herein incorporated by reference. There, a torsion spring 44 biases lever 43 against cam faces of inner and outer hubs 31 and 32. This design enables either hub to be rotated clockwise or counterclockwise from a default position to retract the latch. The design also biases both inner and outer hubs toward the intermediate, non-latch-retracting position, when neither of the hubs 31 or 32 is operated. But when one of the hubs 31 or 32 is operated to retract the latch retractor assembly, the lever 43 no longer biases the non-operated hub toward its default position. While one remedy for this deficiency is to include biasing springs in each side of the trim, this prevents the mortise lock body from being used with pre-existing trim assemblies that cannot accommodate such biasing springs.

There is a need for an improved biasing mechanism for a dual-cam mortise latchset in which either an outside or an inside lever-type handle can rotate both clockwise and counterclockwise from a default, intermediate, inactive position to operate the latch retracting works. There is a need for the biasing mechanism to be housed inside the mortise latchset body and be operable to independently bias each operating cam and its corresponding lever-type handle to the default, inactive position, including during circumstances when one of the operating cams is rotated to operate the latch retracting works. There is also a need for the biasing mechanism to be sufficiently strong to bias conventional lever-type handles to a horizontal position without assistance from trim package springs.

Meeting these needs, however, is made even more challenging under certain design constraints. One example of such a design constraint is that the mortise latchset body be compatible with trim that attaches to the mortise latchset body through trim post holes located at the twelve and six o-clock positions above and below the operating cams. The location of the trim's posts would interfere with springs positioned like those shown in U.S. Pat. No. 4,071,270 to Alexander or U.S. Pat. No. 4,589,691 to Foshee et al.

Another example of a design constraint is that the mortise latchset be "reversibly-handed" or "field-reversible." Mortise latchsets are often "handed," that is, assembled for installation in either a left-hand door or a right-hand door, but not both. To convert a handed mortise latchset assembled for a left-hand installation to one adapted for right-hand installation, or vice-versa, it is often necessary to remove the cover from the case assembly, and then dismount, rotate or reverse, and remount several components (including the latchbolt, guardbolt, and spindle hubs) in the mortise latchset body. The background section of U.S. patent application Ser. No. 12/424,091 depicts an example of a prior art handed mortise latchset.

By contrast, a field-reversible mortise latchset is a reversibly-handed latchset in which it is not necessary to remove the cover from the case assembly in order to convert the lock from a left-hand installation to a right-hand installation. Field-reversible or reversibly-handed latchsets typically include additional hardware that would also interfere with conventional placements of biasing springs.

The above-mentioned design constraints are illustrated in connection with, or in contrast to, FIGS. 1 and 2, which illustrate an example of a prior-art field-reversible mortise lock and lock body assembly 10.

The present invention, however, can be characterized in many different ways, not all of which are limited by the above-mentioned needs or design constraints.

SUMMARY OF THE INVENTION

A mortise latchset is provided comprising a mortise latchset body housing a latchbolt and inner and outer operating cams journaled inside the mortise latchset body for independent coaxial movement relative to each other. Each of the operating cams is operable to rotate both clockwise and counterclockwise from an intermediate position to retract the latchbolt. Trim is provided exterior to the mortise latchset body, including inside and outside door handles, optionally of the lever-type. The handles are coupled to and operable to rotate the inner and outer operating cams both clockwise and counterclockwise from an intermediate position to retract the latchbolt. A spring assembly housed inside the mortise latchset body is operable to spring-load one of the handles while it is being rotated clockwise or counterclockwise, while still spring-loading the other of the handles to maintain it in the intermediate position. The spring assembly has sufficient force to spring load conventional lever-type handles without any assistance from springs housed within the trim.

The spring assembly can be characterized in that it comprises a cantilevered spring, or two or more such springs layered over each other.

The mortise latchset may be further characterized as a field-reversible lockset, one that includes a reversible locking slider operable to be selectably positioned over one or the other of the operating cams. Trim post holes for mounting the trim may be located adjacent the operating cams, above and below the operating cams, at 12 and 6 o-clock positions, respectively.

The mortise latchset may be alternately characterized as a mortise latchset body and assembly operable to be coupled to pre-existing trim that includes lever-type door handles, with no handle-centering biasing springs housed within the trim.

The mortise latchset may also be characterized as comprising a case assembly and cover; inner and outer operating cams journaled in the case assembly and cover for independent coaxial movement relative to each other; and a pair of coaxially-mounted, independently leveraged cam followers mounted in the case assembly, each cam follower being mounted for engagement with one or more cam operating surfaces of one of the inner and outer operating cams. A retractable latchbolt is supported in the case for movement between projected and retracted positions. The latch retractor assembly is operable to retract the latchbolt, wherein each of the cam followers is operable to drive the latch retractor assembly into a latchbolt-retracting position.

The mortise latchset may also be characterized in that each of the cam followers is independently spring-biased to bias its corresponding operating cam into a handle-centering position. The cam followers are spring-biased by at least one flat cantilevered spring, which may optionally be in the form of a two-pronged forked spring. The mortise latchset further comprises a torsion spring to bias the latch retractor assembly against the cam followers towards their corresponding operating cams.

The operating cams are operable to be rotated in either clockwise or counterclockwise directions from a handle-centering position, and in both directions to engage the latch retractor assembly to retract the latchbolt, whereby rotation of the inside and outside door handles in either direction is operable to rotate the cams.

Each of the operating cams includes angularly displaced divaricate cam projections operable to engage the cam followers, and in turn the latch retractor assembly, to retract the latchbolt when the operating cam is rotated in either direction.

DETAILED DESCRIPTION

In describing preferred and alternate embodiments of the technology described herein, as illustrated in FIGS. 1-17, specific terminology is employed for the sake of clarity. The technology described herein, however, is not intended to be limited to the specific terminology so selected, and it is to be understood that each specific element includes all technical equivalents that operate in a similar manner to accomplish similar functions.

I. Conventional Elements

Figure 1:
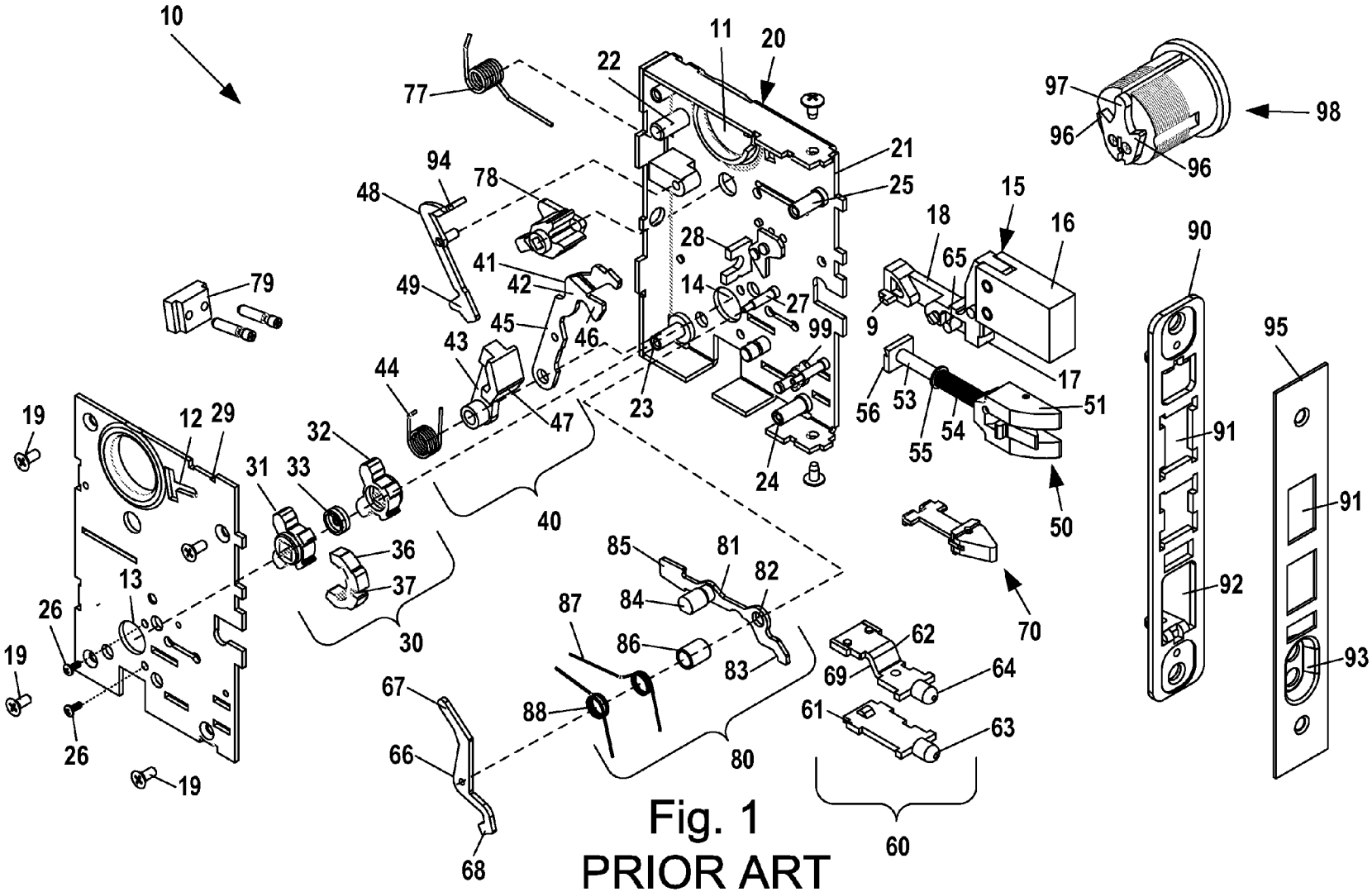
Fig. 1 PRIOR ART
FIG. 1 is an exploded view of a prior art field-reversible mortise lockset.
Figure 2:
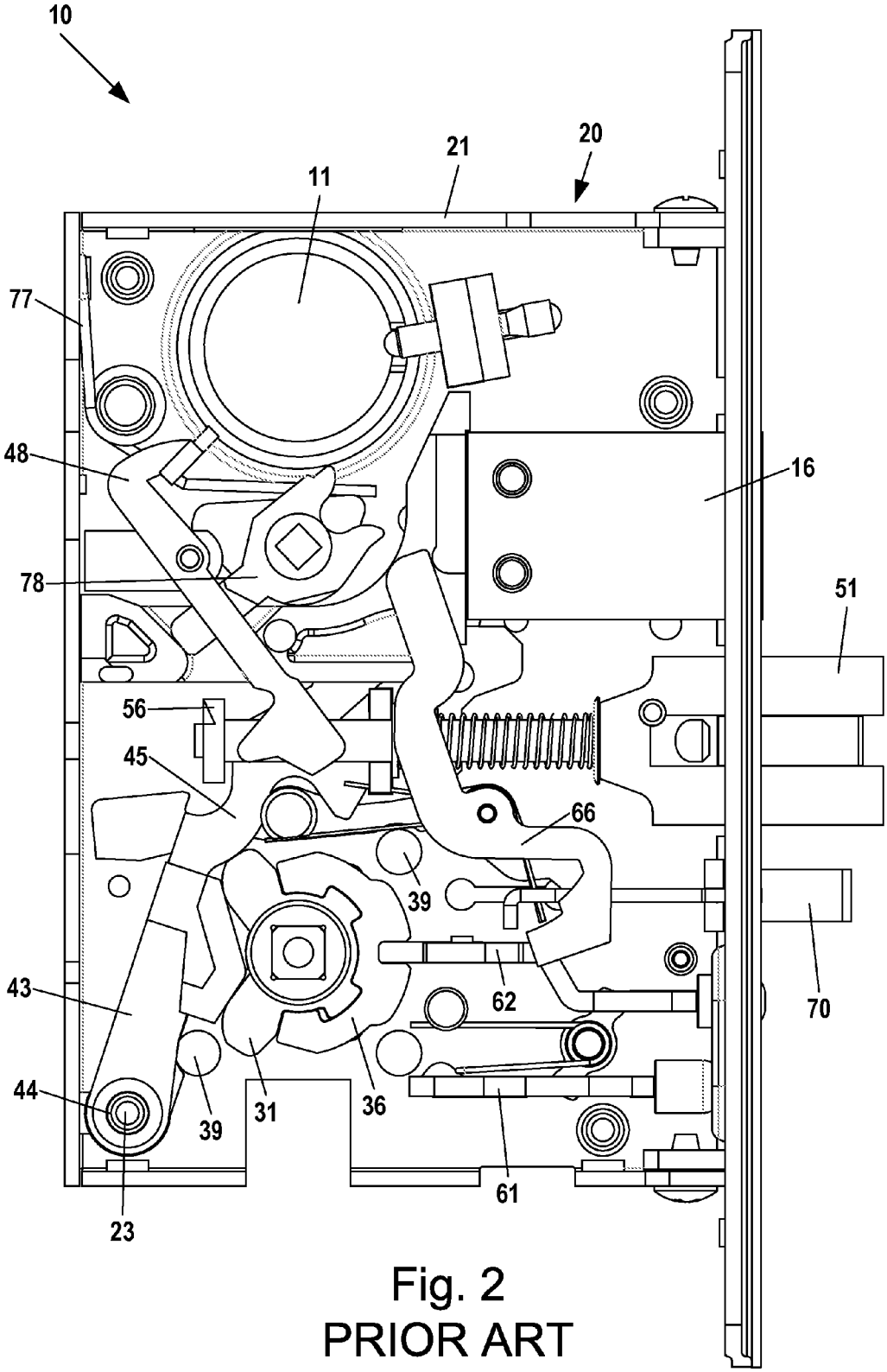
Fig. 2 PRIOR ART
FIG. 2 is a partially cut-away side view of the prior art mortise lockset of FIG. 1.
Figure 3:
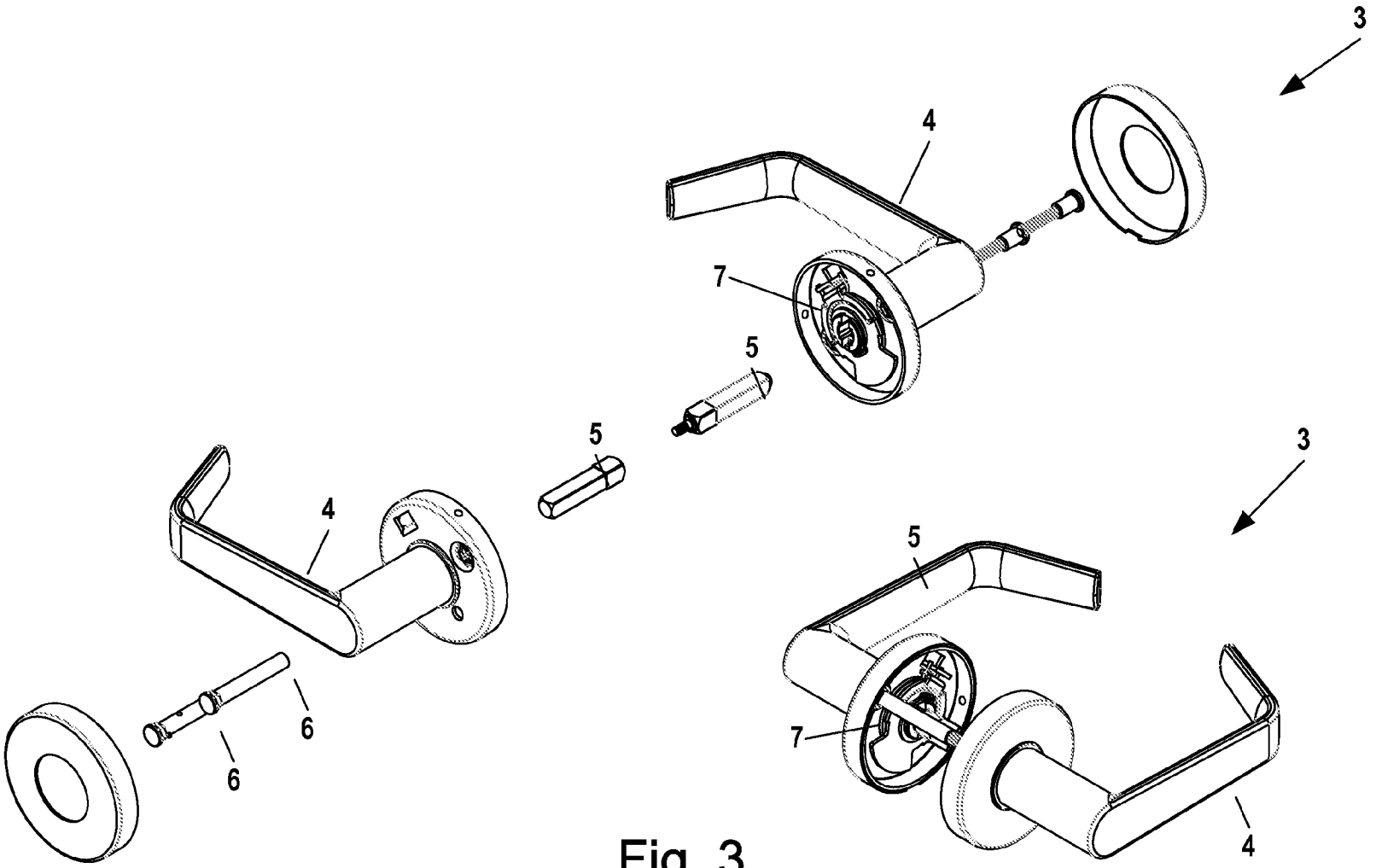
Fig. 3 PRIOR ART
FIG. 3 is an exploded view diagram of a prior art embodiment of a handle-type lever trim package for the mortise lockset of FIG. 1.

To highlight some of the novel components in the present invention, comparison is made with FIGS. 1-2, which illustrates a prior art mortise lock and lock body 10 and its conventional elements. FIG. 3 illustrates a prior art trim set with springs embedded in the trim to bias the lever handles toward a default, horizontal position. The illustrated embodiments of the present invention use many of the same conventional elements illustrated in FIGS. 1-3. It should be noted, however, that FIGS. 4-17 do not illustrate prior art latchsets, because they contain several new elements according to the present invention.

The mortise lockset assembly 10 mounts in a door opposite a strike plate on a door jamb (not shown). The assembly 10 includes a mortise lockset body, including a steel housing comprising a case assembly 20 and cover 29, a deadbolt assembly 15, a locking dual-cam assembly 30, a principal latch refractor assembly 40, a secondary, key-operated latch retractor 48, a main bolt or latchbolt assembly 50, a stop works assembly 60, an auxiliary latch or guardbolt assembly 70, a blocker assembly 80, an inside front plate 90, also referred to as an armor plate, and an outside front plate 95, also referred to as a scalp plate or face plate.

The case assembly 20 comprises a case 21 with several parts—including interiorly threaded posts 22-25, pivot shaft or pin 27, and latchbolt stem guide 28—stacked on the case 21. Exteriorly threaded case screws 19 secure the cover 29 to the posts 22-25 of the case 21. A tap hole 11 is provided for a keyed cylinder assembly 98 that is mounted in the case assembly 20. A screw block and cylinder screw assembly 79 mounts in corresponding slots 12 in the case 21 and cover 29 to secure the keyed cylinder assembly 98 within the case assembly 20. The keyed cylinder assembly 98 has a key-operated teardrop cam 97 and ear cams 96 that interact with bistable deadbolt cam or hub 78 and the paddle 94 of the key-operated latch retractor 48 to operate the deadbolt 16 and latchbolt 51. Deadbolt cam 78 is spring-biased in either the fully retracted or fully extended positions by deadbolt cam spring 77.

The locking dual cam assembly 30 is coupled by spindles 5 to the inside and outer door knobs or handles 4. The locking dual cam assembly 30 comprises an outer operating cam or hub 31, an inner operating cam or hub 32, a cam spacer or bushing 33, and a reversible, horseshoe-shaped locking slider 36. The outer operating cam 31—also referred to as an exterior operating cam or hub—is coupled to the outside door knob or handle. The inner operating cam 32—also referred to as an interior operating cam or hub—is coupled to the inside door knob or handle. The bushing 33 separates cams 31 and 32. Cams 31 and 32, which are independently rotatable, are journaled in circular journal apertures 13 and 14, respectively, in the cover 29 and case 21. Both cams 31 and 32 have angularly displaced divaricate cam surfaces that, when rotated, and regardless of the direction they are rotated, drive the principal latch retractor assembly 40 in a counter-clockwise direction (in relation to FIG. 2's perspective), into a retracted position. The principal latch retractor assembly 40, when driven in the counter-clockwise direction, retracts the latchbolt assembly 50 into the case assembly 20.

The reversible locking slider 36 is slidably engaged with one or the other of the operating cams 31 and 32. The slider 36 is operable to be selectably positioned, via handing screws 26 selectively positioned on either the case 21 or the cover 29, over one or the other of the operating cams 31 or 32. The slider 36 can be repositioned from one of the operating cams 31 or 32 to the other by removing the handing screws 26 from one side of the mortise lockset body and replacing them on the other side.

The principal latch retractor assembly 40 is pivotally mounted on post 23, which doubles as a pivot shaft. The principal latch retractor assembly 40 comprises a lower latch retractor or biasing lever 43, a biasing spring 44 that biases the biasing lever 43 in a clockwise direction (in relation to FIG. 1's perspective), and a latch retractor arm or operating lever 45. The biasing lever 43 has a roof-shaped face 47 that engages the cam surfaces 34 and 35 of the locking dual cam assembly 30, biasing the assembly 30 into a default orientation and the cams 31 and 32 into alignment with each other. Turning one of the door knobs or handles (not shown) causes one of the divaricate cam surfaces of cams 31 or 32 to drive the biasing lever 43—and the operating lever 45 to which it is mounted—back in a counter-clockwise direction. The operating lever 45, in turn, retracts the latchbolt assembly 50 into the case assembly 20.

Figure 9:
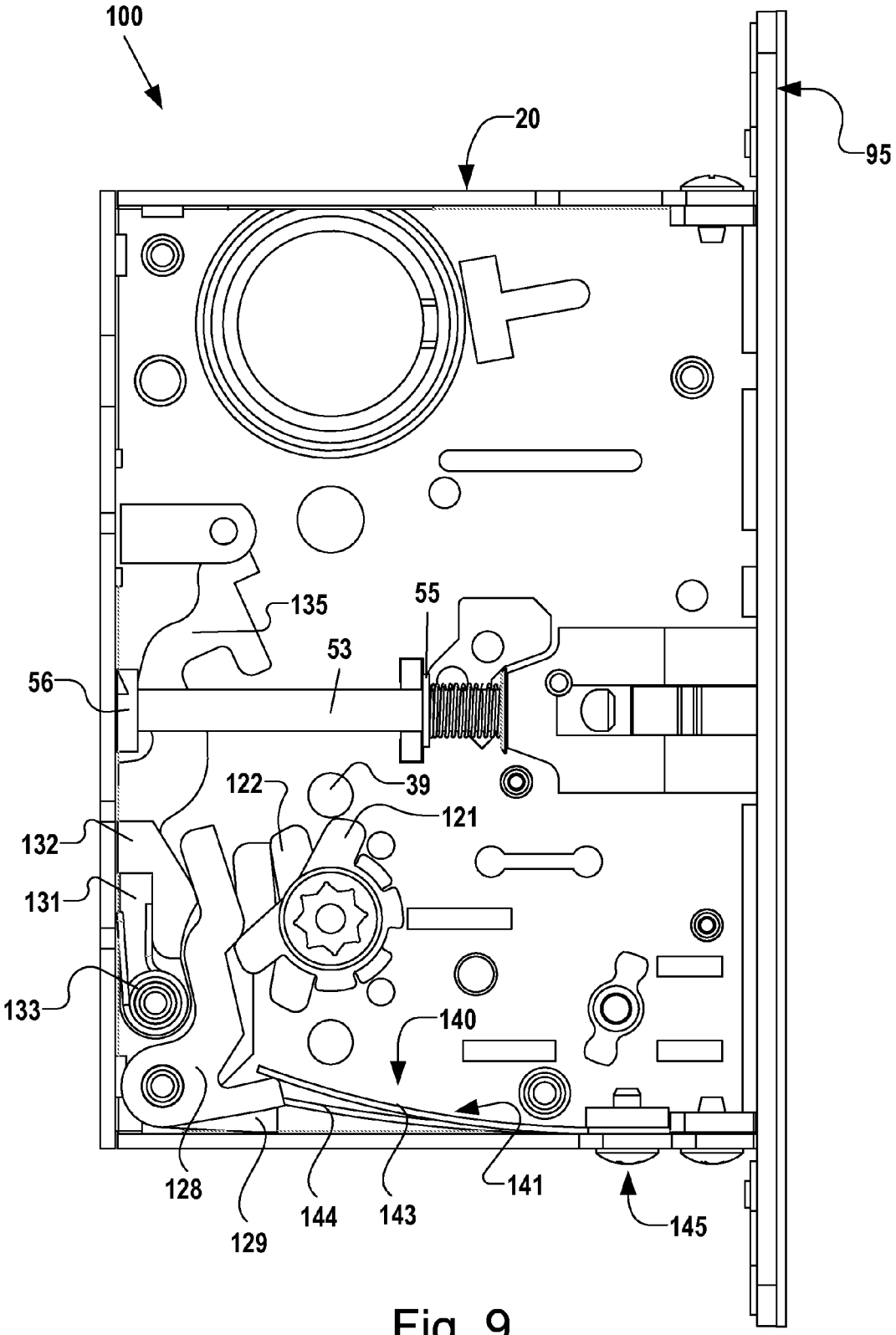
FIG. 9 is a partially cut-away side view of the dual-cam mortise latchset of FIG. 4 with the cover side cam rotated clockwise, with the biasing mechanism continuing to center the case side cam in its default, intermediate position.

A secondary, key-operated latch retractor 48 is also provided. FIG. 9 of U.S. patent application Ser. No. 12/424,091 depicts the latch retractor 48 in its most extreme counter-clockwise orientation, where the paddle 94 is out of the way of teardrop cam 97. Turning a key in the keyed cylinder 98 toward the unlocking position (which would be counterclockwise on FIG. 9 of U.S. patent application Ser. No. 12/424,091) turns teardrop cam 97 to drive deadbolt cam 78 clockwise. This retracts the deadbolt 51, causing deadbolt pin 65 to push latch retractor 48 into a paddle-engageable position. As the keyed cylinder 98 is rotated further, the teardrop cam 97 comes into contact with paddle 94 and pivots the secondary latch retractor 48 in a further clockwise direction. This, in turn, pulls the latchbolt assembly 50 into the retracted position.

Turning a key in the keyed cylinder 98 toward the locking position pushes the paddle 94 in the opposite direction, which pivots the secondary latch retractor 48 in the counter-clockwise direction. The latch retractor 48 is then driven to its most extreme counter-clockwise orientation by another deadbolt pin 9.

The main bolt or latchbolt assembly 50 comprises a three-pronged latchbolt 51, including a two-pronged yoke and a pivotally-mounted, trigger-activated single prong, a stem or shaft 53, a coil extension spring 54, a washer 55, and a tail plate 56. The stem 53 is mounted in the latchbolt stem guide 28, which doubles as a stop for the coil extension spring 54. The spring 54 presses the washer 55 against the right side (in relation to FIG. 1's perspective) of the latchbolt stem guide 28. The operating lever 45 is mounted in the case assembly 20 so that a head portion 42—which extends from a tail-plate-engaging surface 41 to a blocker engagement arm 46—is positioned between the tail plate 56 and the latchbolt stem guide 28. Also, the latch retractor 48 is mounted in the case assembly 20 so that a head portion 49 is generally positioned between the tail plate 56 and the latchbolt stem guide 28.

The purpose of the stop works assembly 60 is to enable a person to lock or unlock the outside door handle or knob by pressing one of two interlinked buttons 63 and 64 that protrude through opening 92 and recess 93 in front plates 90 and 95. The stop works assembly 60 comprises an upper locking slide 62 and an interlinked lower slide 61. When the upper locking slide 62 moves inward, it engages a slot 37 on the reversible locking slider 36, preventing the rotation of the hub 31 or 32 to which the slider 36 is engaged. This in turn prevents rotation of the corresponding door handle or knob 4. The upper locking slide 62 does not, however, interfere with rotational movement of the other hub 31 or 32 to which the slider 36 is not engaged. Therefore a person is still free to turn the door handle or knob connected to the non-locking hub 31 or 32 to retract the latchbolt 51 and open the door. The slides 61 and 62 are coupled together by gear 99. Therefore, inward movement of the lower slide 61 causes corresponding outward movement of upper locking slide 62, thereby releasing the hub 31 or 32 to which the slider 36 is engaged.

The stop works assembly 60 is engaged and disengaged by several mechanisms. A person can press on button 64 to force the slide 62 into engagement with slot 37 of slider 36. Also, projection of the deadbolt assembly 15 into the door jamb causes a deadbolt pin 65 to engage the top 67 of a pivotally-mounted deadbolt lever 66, driving the bottom 68 of the lever 66, which is engaged in a side slot 69 of the upper locking slide 62, in the opposite direction. If the slide 62 is already engaged with slot 36, a person can press on button 63 to disengage it. Also, retraction of the deadbolt assembly 15 drives the lever 66 in reverse, freeing a person to push button 63 to disengage the stop works 60.

The purpose of the auxiliary latch or guardbolt assembly 70 and blocker assembly 80 is to prevent a person from "biding" the latchbolt assembly 50 into a retracted position when the door is shut. The guardbolt assembly 70 comprises a bolt portion with a beveled face, a stem, and tab ramps. There is no recess in the strike plate (not shown) to receive the guardbolt assembly 70. Consequently, shutting a door having the mortise lock assembly 10 shown in FIG. 1 forces the guardbolt assembly 70 into a retracted position. In the retracted position, and guardbolt assembly 70 engages the blocker assembly 80 to prevent the latchbolt assembly 50 from retracting, unless the dual cam assembly 30 is engaged to retract the latchbolt assembly 50.

The blocker assembly 80 comprises a cam arm 81, a bushing 86, a blocker spring 87, and a guardbolt or auxiliary latch spring 88, all of which are mounted on pivot shaft 27 of the case assembly 20. A ramp 83 on the underside of the cam arm 81 exists to the right (in relation to FIG. 1's perspective) of a mounting hole 82. A side arm 84 and hook 85 exists to the left of the mounting hole 82. When the guardbolt assembly 80 moves from a retracted to an extended position, one of the tab ramps 74 or 75 engages the ramp 83 of the cam arm 81, causing the right portion of the cam arm 81 to pivot upward, and the left portion to pivot downward. When the guardbolt assembly 80 moves from an extended to a retracted position—as would occur when a person shut the door—blocker spring 87 biases the cam arm 81 to pivot clockwise. As the left portion of the cam arm 81 is pivoted upward, the hook 85 obstructs the path of the tail plate 56 of the latchbolt assembly 50, preventing its retraction.

Two mechanisms are provided to overcome the spring-biased blocking position of the cam arm 81. First, rotation of the latch retractor assembly 40 (a consequence of turning a door handle) causes the blocker engagement arm 46 of the operating lever 45 to engage the side arm 84. Second, turning a key in the keyed cylinder 98 to a fully unlocked position drives the latch retractor 48 clockwise, causing the head portion 49 to engage the side arm 84. Both mechanisms push the left portion of the cam arm 81 downward and the hook 85 outside of the path of the tail plate 56.

Springs 87 and 88 are mounted on bushing 86. The guardbolt spring 88 biases the guardbolt assembly 70 into the extended position. The blocker spring 87 biases the cam arm 81 into a blocking position.

The deadbolt assembly 15 comprises a deadbolt 16, a deadbolt stop 17, and a deadbolt tailpiece 18. A bolt portion 16 moves between a deadbolt retracted position, where it is disposed within the housing, and a deadbolt extended position, where it protrudes through deadbolt openings 91 in the front plates 90 and 95. As the bolt portion 16 moves into its extended position, a deadbolt stop 17 comes into contact with post 25, which functions as a housing stop that restrains further outward movement past the deadbolt extended position.

FIG. 3 illustrates exploded and assembled views of a conventional trim set 3. Trim set 3 comprises inside and outside lever-type handles 4, spindles 5 for coupling the handles to the operating cams 31 and 32, trim posts 6 for mounting the trim set 3 to the body of the mortise lockset 10 at forty-five and two-hundred-and-twenty-five degree positions, and trim springs 7 to bias the lever-type handles into lever-centering positions.

II. New Dual Cam Leveraging Mechanism

FIGS. 4-17 illustrate an improved mortise latchset 100 with a new dual cam leveraging mechanism. The term "latchset" is used in place of "lockset" because the improved mechanism is suitable for both mortise locksets and mortise latch assemblies that lack any locking mechanism. The mortise latchset 100 comprises a mortise latchset body including case assembly 20 and cover 29 coupled together via interiorly threaded posts 151-155, a leveraged dual cam assembly 120, a latch retractor assembly 130, and a leveraging spring assembly 140.

The leveraged dual cam assembly 120, like the locking dual cam assembly 30 of FIGS. 1-2, comprises an outer, cover-side operating cam or hub 121 and an inner, case-side operating cam or hub 122. The outer and inner operating cams 121 and 122 are journaled in the case assembly 20 and cover 29 for independent coaxial movement relative to each other. A cam or hub spacer or bushing 123 separates the operating cams 121 and 122, and permits the cams 121 and 122 to rotate independently of each other. The dual cam assembly 120 also optionally comprises a reversible, horseshoe-shaped locking slider 126. The reversible locking slider 126 is slidably engaged with one or the other of the operating cams 121 and 122. The slider 126 is operable to be selectably positioned, via handing screws 26 selectively positioned on either the case 21 or the cover 29, over one or the other of the operating cams 121 or 122 to enable locking of that cam 121 or 122. The slider 126 can be repositioned from one of the operating cams 121 or 122 to the other by removing the handing screws 126 from one side of the mortise latchset body and replacing them on the other side.

The leveraged dual cam assembly 120, also like the dual cam assembly 30 of FIGS. 1-2, is coupled by spindles (not shown) to the inside and outer door knobs or handles (also not shown). The outer operating cam 121 is coupled to the outside door knob or handle. The inner operating cam 122 is coupled to the inside door knob or handle. Both cams 121 and 122 also have angularly displaced divaricate cam surfaces 124 and 125.

Unlike the mortise lockset 10 of FIGS. 1-2, the mortise latchset 100 of FIGS. 4-17 includes a pair of independently leveraged cam followers 128 and 129 mounted in the case assembly 20. The cover side cam follower 128 is mounted for engagement with the divaricate cam surfaces 124 and 125 of the outer or cover-side operating cam 121. The case side cam follower 129 is mounted for engagement with the divaricate cam surfaces 124 and 125 of the case-side operating cam 122. Both cam followers 128 and 129 are coaxially-mounted on an interiorly threaded post 153 (also used to secure the cover 29 to the case 21) near the bottom left corner of the case assembly 20. Each cam follower 128 and 129 includes a roof-shaped face configured to engage both divaricate cam surfaces 124 and 125 of the corresponding cam 121 or 122 when the cam is in its default, intermediate, handle-centering, non-latch-retracting position, and cam follower 128 or 129 is in its most clockwise position. The cam surfaces 124 and 125 of each cam 121 and 122 are also configured to urge its corresponding cam follower 128 or 129 in a counterclockwise direction any time the cam 121 or 122 is rotated away—whether in the clockwise or counterclockwise direction—from its default, intermediate, handle-centering non-latch-retracting position.

Also unlike the mortise lockset 10 of FIGS. 1-2, the mortise latchset 100 of FIGS. 4-17 includes a stiff spring assembly 140 that independently spring-biases each cam follower 128 and 129 and its corresponding cam 121 or 122 to its intermediate, handle-centering position. The spring assembly 140 comprises one (FIGS. 4-12) or more (FIGS. 13-17) flat cantilevered springs 141-142. In the depicted embodiments, each cantilevered spring 141 and/or 142 is a forked spring with first and second spring-loaded prongs 143 and 144. The cantilevered springs 141 and/or 142 are located adjacent to and parallel with the bottom side of the case 21, and secured to the bottom right side of the case 21, near its intersection with the faceplate 95, by a spring retaining assembly 145. The screw retaining assembly 145 comprises a screw or bolt 146 and square retaining nut 147.

Each cam follower 128 and 129 includes a foot 138 or 139 with which to leverage the cam follower 128 or 129 against its corresponding cam 121 or 122. Each foot 138 and 139 is positioned under the corresponding prong 143 or 144 of the spring assembly 140, which independently biases each of the cam followers 128 and 129 into their clockwise-most position.

When one of the cams 121 and 122 is rotated, one or the other of its divaricate cam surfaces 124 or 125 urges the corresponding cam follower 128 or 129 in a counterclockwise direction. That cam follower 128 or 129, in turn, presses against the roof-shaped face 132 of a secondary cam follower and biasing lever 131, urging it also in a counterclockwise direction.

The secondary cam follower 131 is similar to the biasing lever 43 of FIGS. 1-2 and is one of the components of a principal latch retractor assembly 130. The principle latch retractor assembly 130 also comprises a torsional hub spring 133 that biases the secondary cam follower 131 in a clockwise direction, and a latch retract arm or operating lever 135. The torsional hub spring 133 biases the latch retractor assembly 130 into a latch-projecting (i.e., non-latch-retracting) position. The secondary cam follower 131 and torsional hub spring 133 are pivotally mounted on a post 152, which doubles as a pivot shaft, just above the post 153 on which the cam followers 128 and 129 are pivoted. When both cams 121 and 122 are in their default, intermediate, lever-centering positions, the torsional hub spring 133 helps reduce load and wear on the spring assembly 140.

Like the mortise lockset 10 illustrated in FIGS. 1-3, the mortise latchset 100 is configured so that when either door handle lever is rotated, whether up or down, the principal latch refractor assembly 130 is driven in a counter-clockwise direction, which in turn pulls the latchbolt 51 into a retracted position inside the case assembly 20. But unlike the mortise lockset 10 of FIGS. 1-3, the mortise latchset 100 includes a spring assembly 140 that has sufficient force to spring load the non-operated handle to a default handle-centering position without any assistance from trim springs. Furthermore, the spring assembly 140 biases the cams indirectly, via the cam followers 128 and 129, unlike more conventional embodiments, such as that depicted in U.S. Pat. No. 4,071,270 to Alexander, which spring bias the cams directly.

In the depicted embodiment, the mortise latchset 100 also provides trim post holes 39 adjacent the operating cams 121 and 122, centered at twelve and six o-clock positions above and below the operating cams. Accordingly, the mortise latchset 100 is compatible with trim that uses trim posts to mount the trim at the twelve and six o-clock positions. It will be understood that other embodiments may—like the prior art embodiments shown in FIGS. 1 and 2—place trim post holes 39 at forty-five and two-hundred-and-twenty-five degree positions, respectively, around the operating cams 121 and 122.

It will be appreciated that the spring assembly 140 is maintained in a position closely proximate the bottom of the case 21, saving space and avoiding interference with the reversible slider 126, the stop work assembly 60, or with trim posts located along the trim post holes 39 positioned at the six and twelve o'clock positions above and below the cams 121 and 122.

Figure 4:
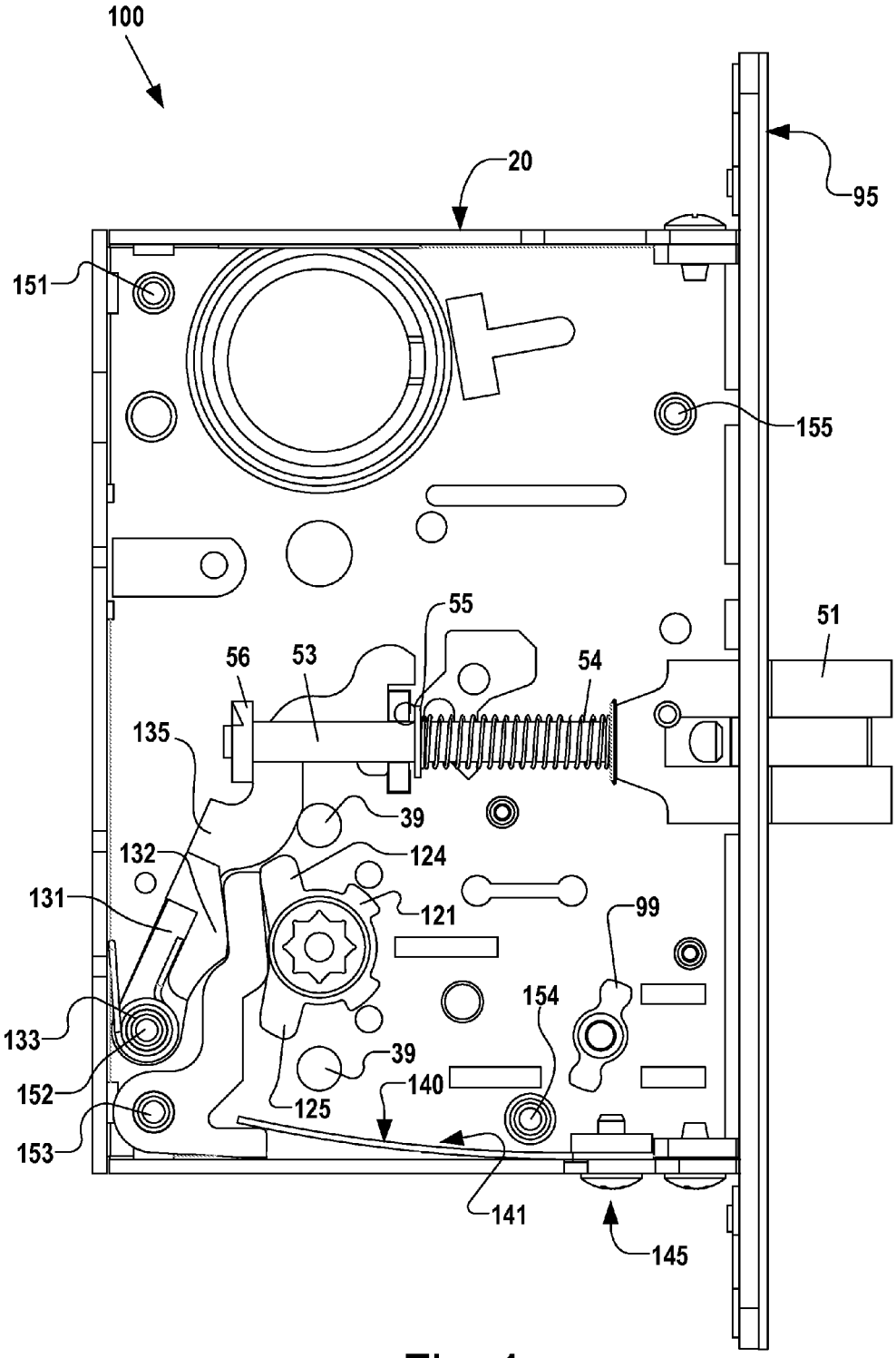
FIG. 4 is a partially cut-away side view of one embodiment of an improved biasing mechanism for a dual-cam mortise latchset, with several components removed for clarity, and with the operating cams in their default, intermediate position.
Figure 5:
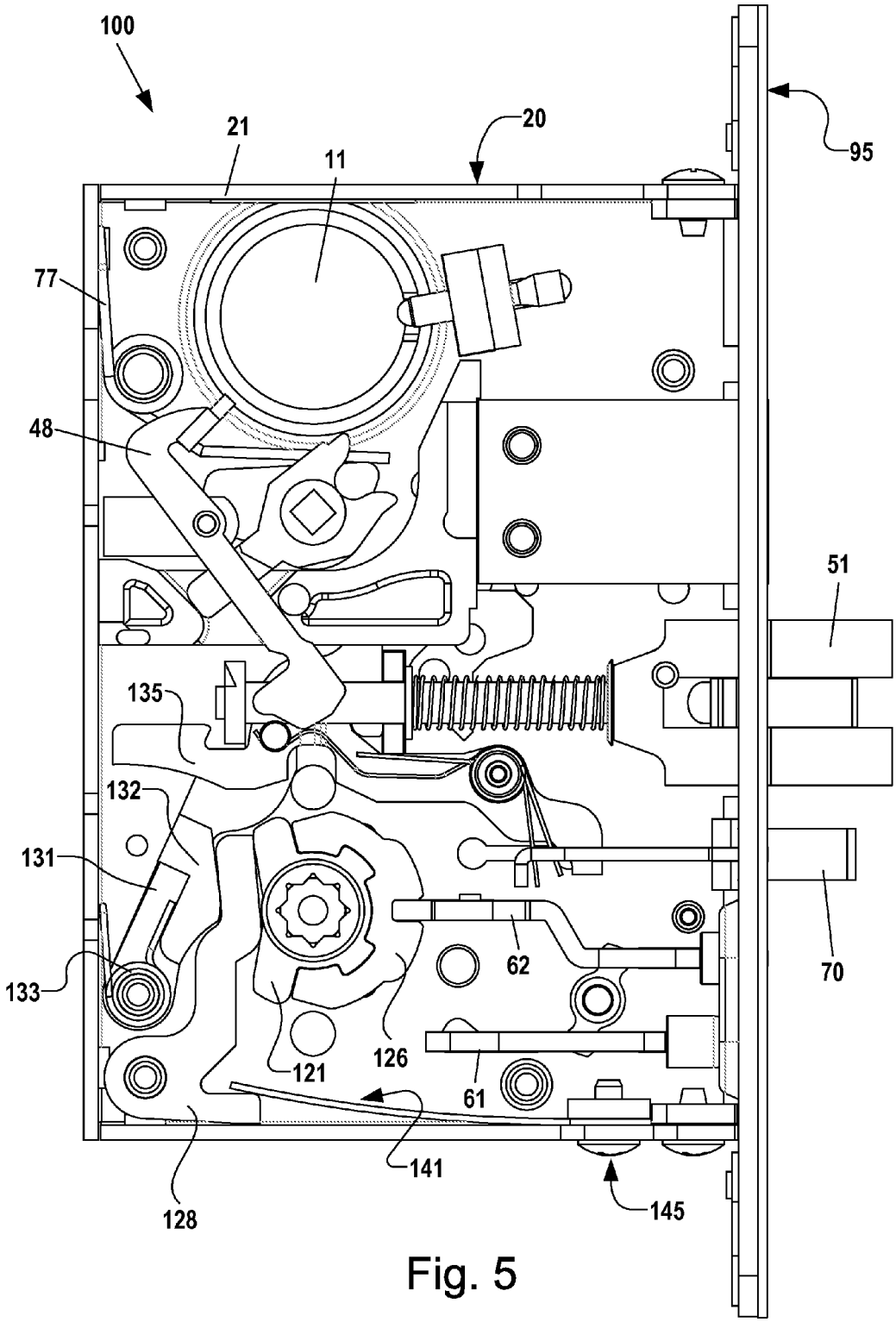
FIG. 5 is another partially cut-away side view of the dual-cam mortise latchset of FIG. 4, showing most of the cooperating components in place.
Figure 6:
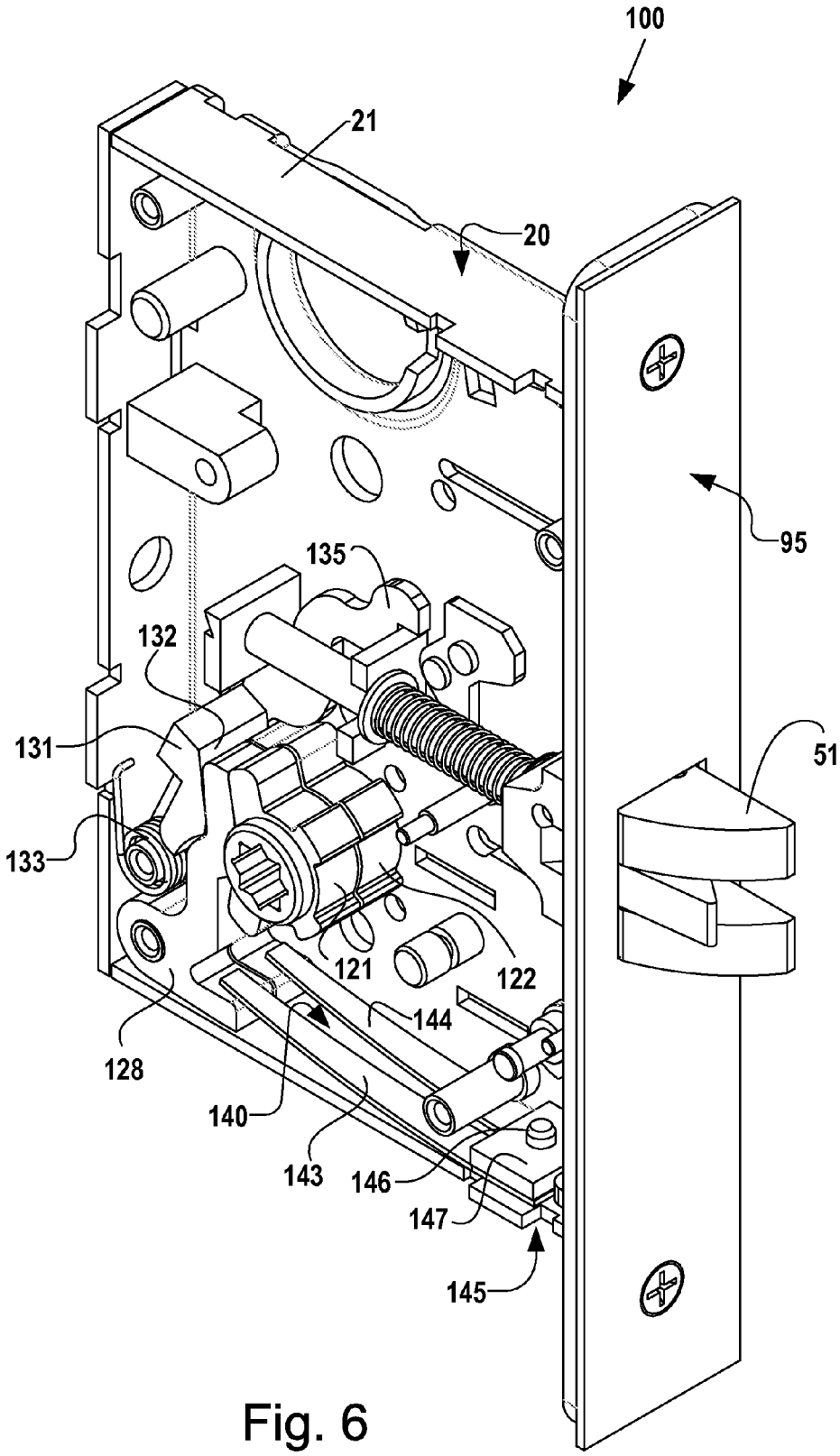
FIG. 6 is a perspective view of the dual-cam mortise latchset of FIG. 4, again with several components removed for clarity.
Figure 7:
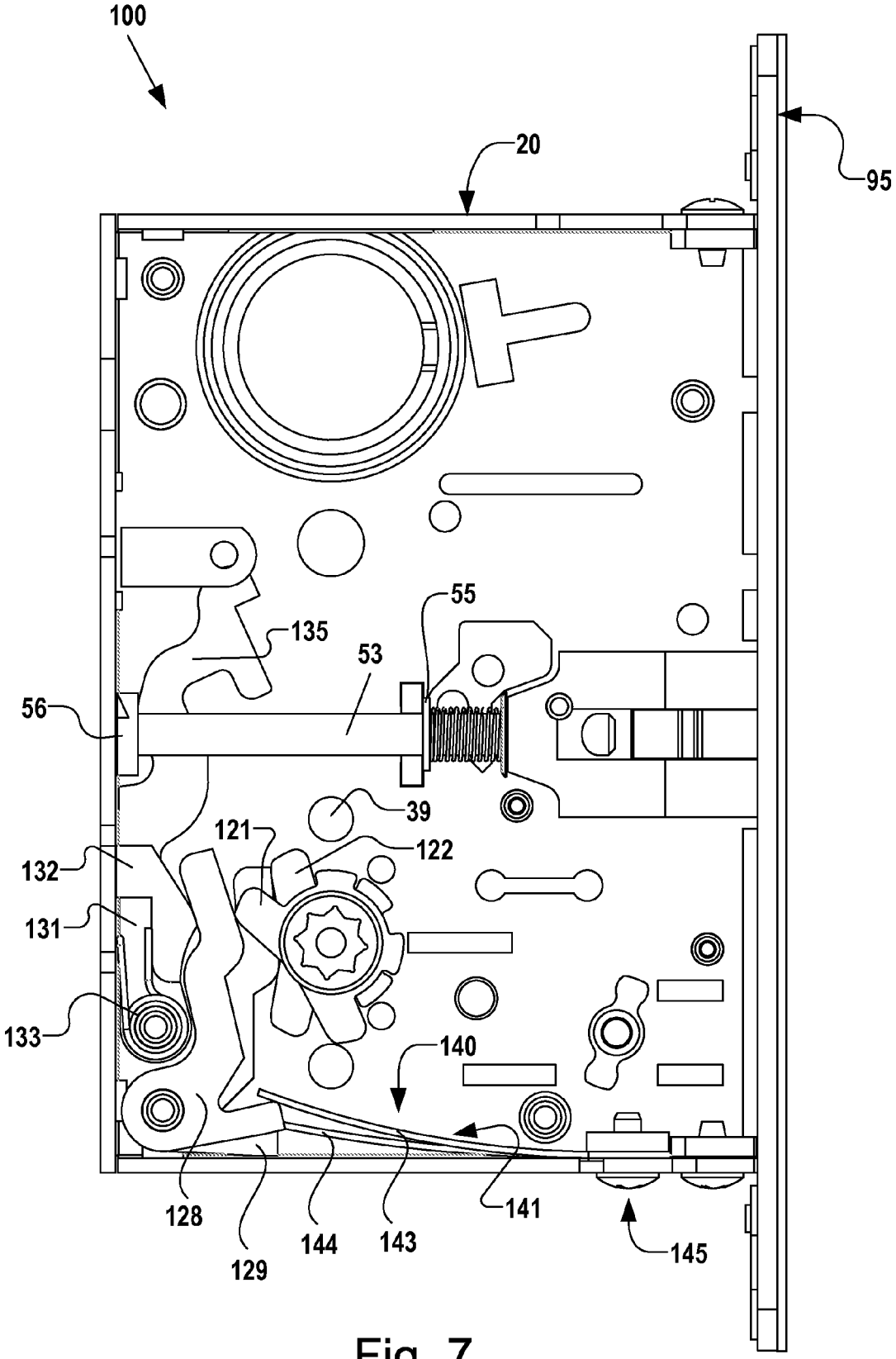
FIG. 7 is a partially cut-away side view of the dual-cam mortise latchset of FIG. 4 with the cover side cam rotated counterclockwise, with the biasing mechanism continuing to center the case side cam in its default, intermediate position.
Figure 8:
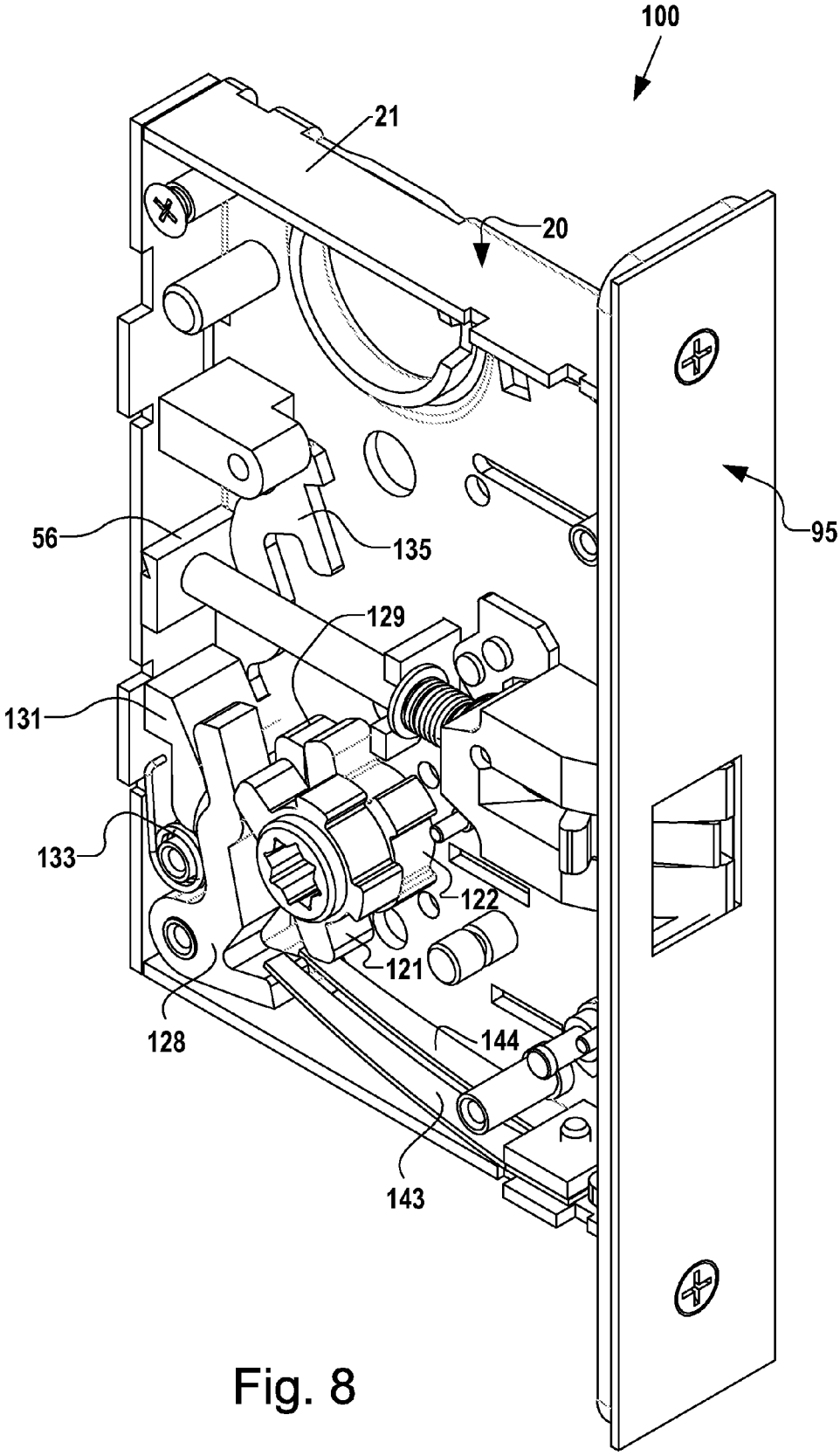
FIG. 8 is a perspective view of the dual-cam mortise latchset of FIG. 7.
Figure 10:
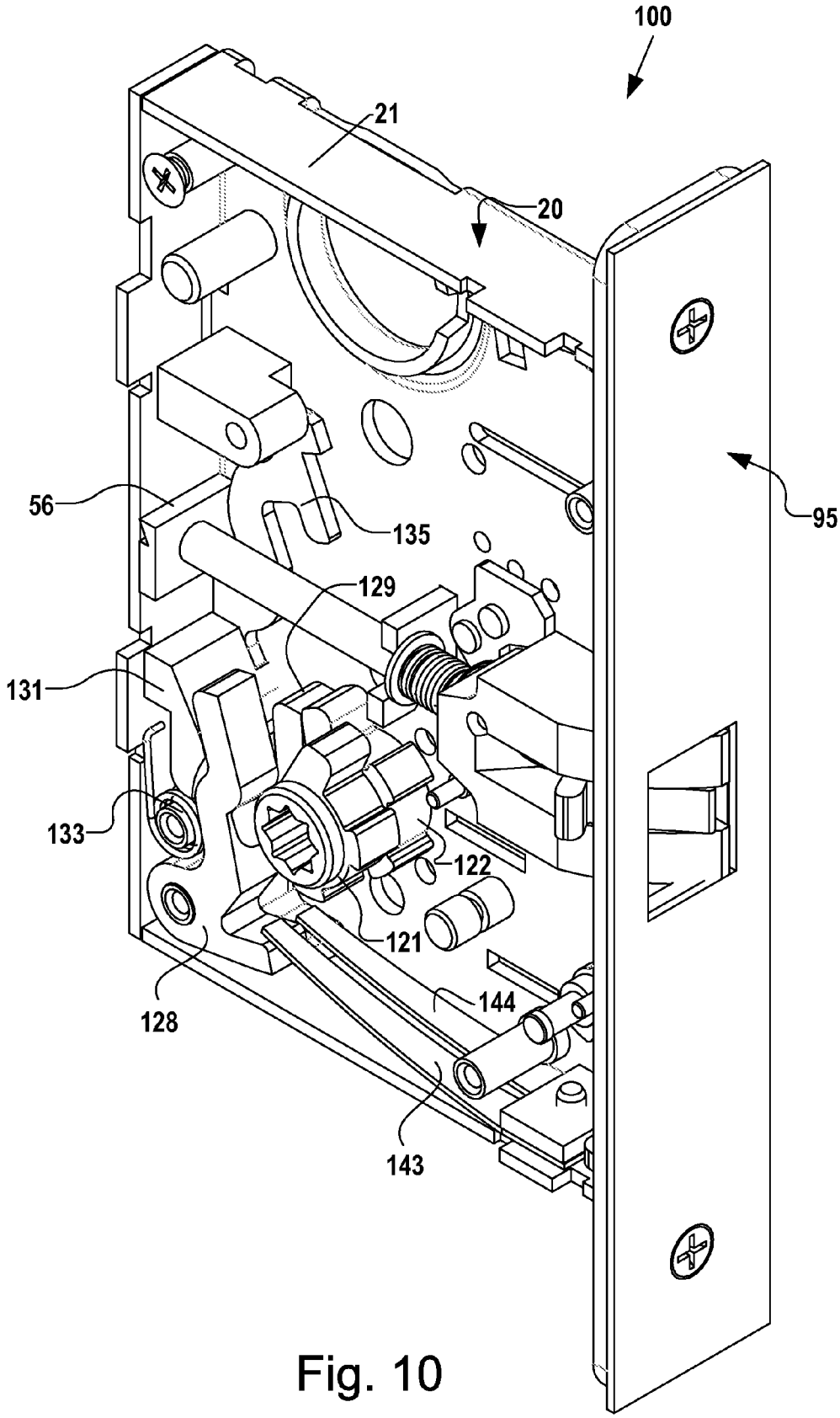
FIG. 10 is a perspective view of the dual-cam mortise latchset of FIG. 9.
Figure 11:
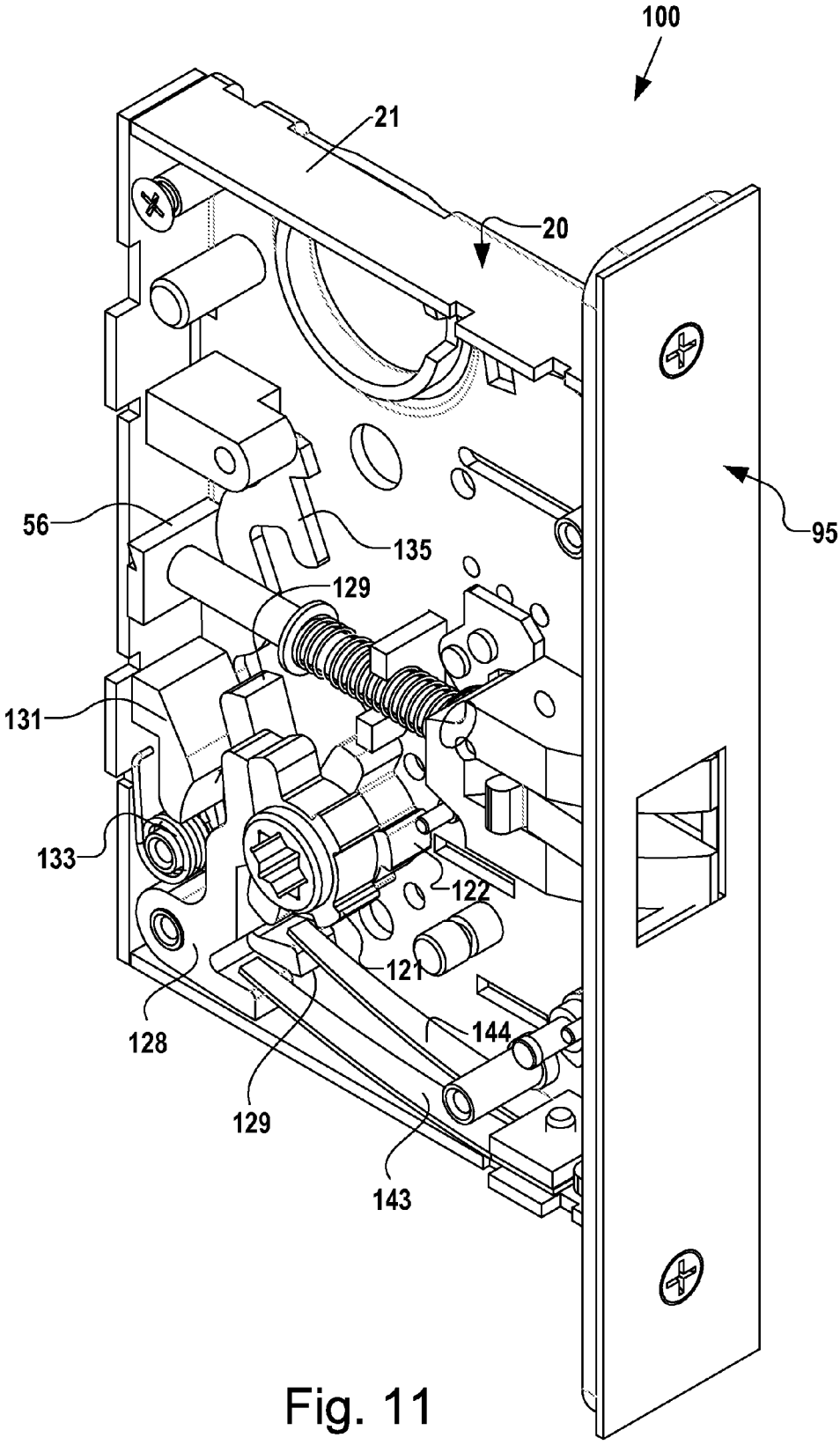
FIG. 11 is a perspective view of the dual-cam mortise latchset of FIG. 4 with the case side cam rotated clockwise, with the biasing mechanism continuing to center the cover side cam in its default, intermediate position.
Figure 12:
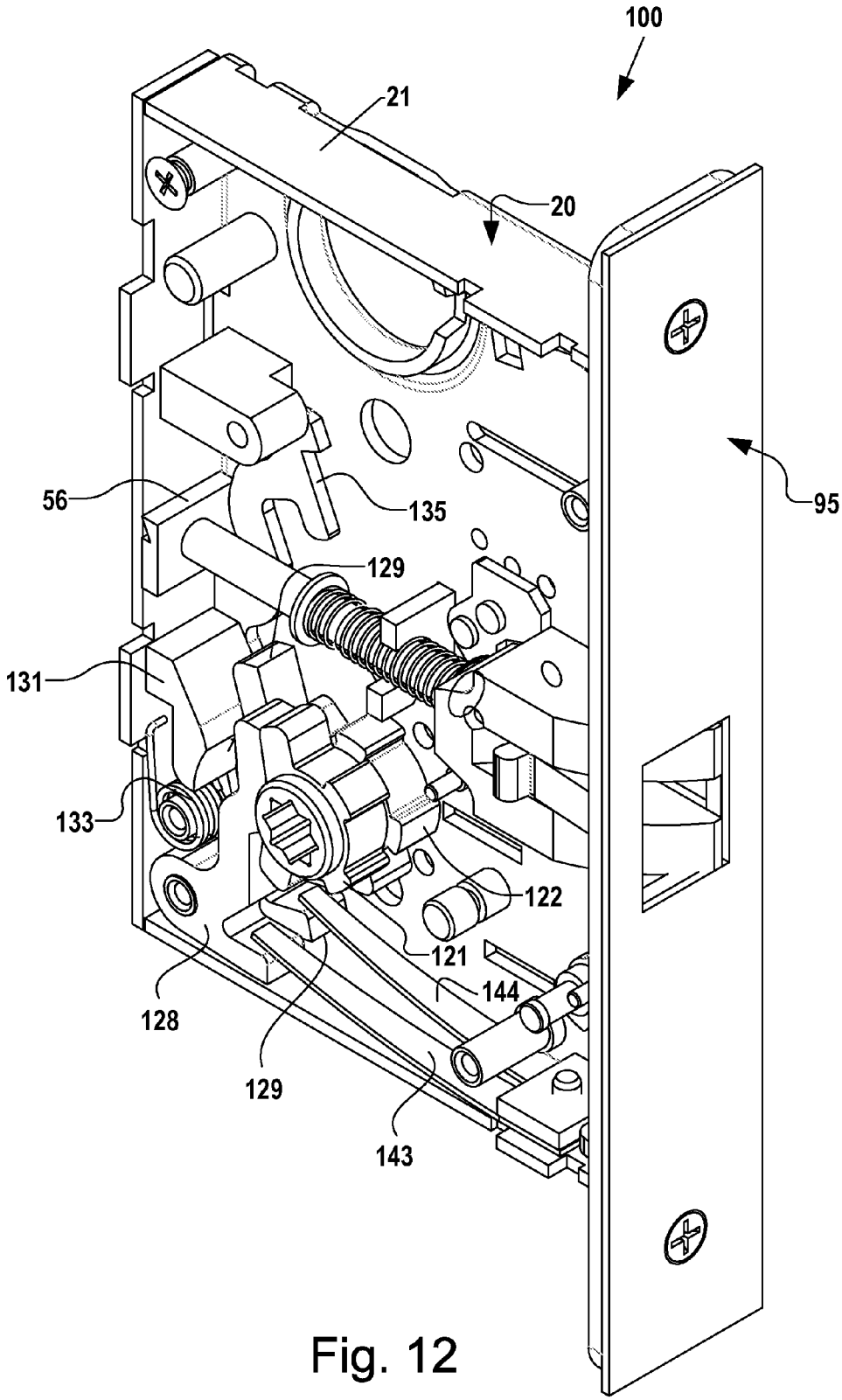
FIG. 12 is a perspective view of the dual-cam mortise latchset of FIG. 4 with the case side cam rotated counterclockwise, with the biasing mechanism continuing to center the cover side cam in its default, intermediate position.
Figure 13:
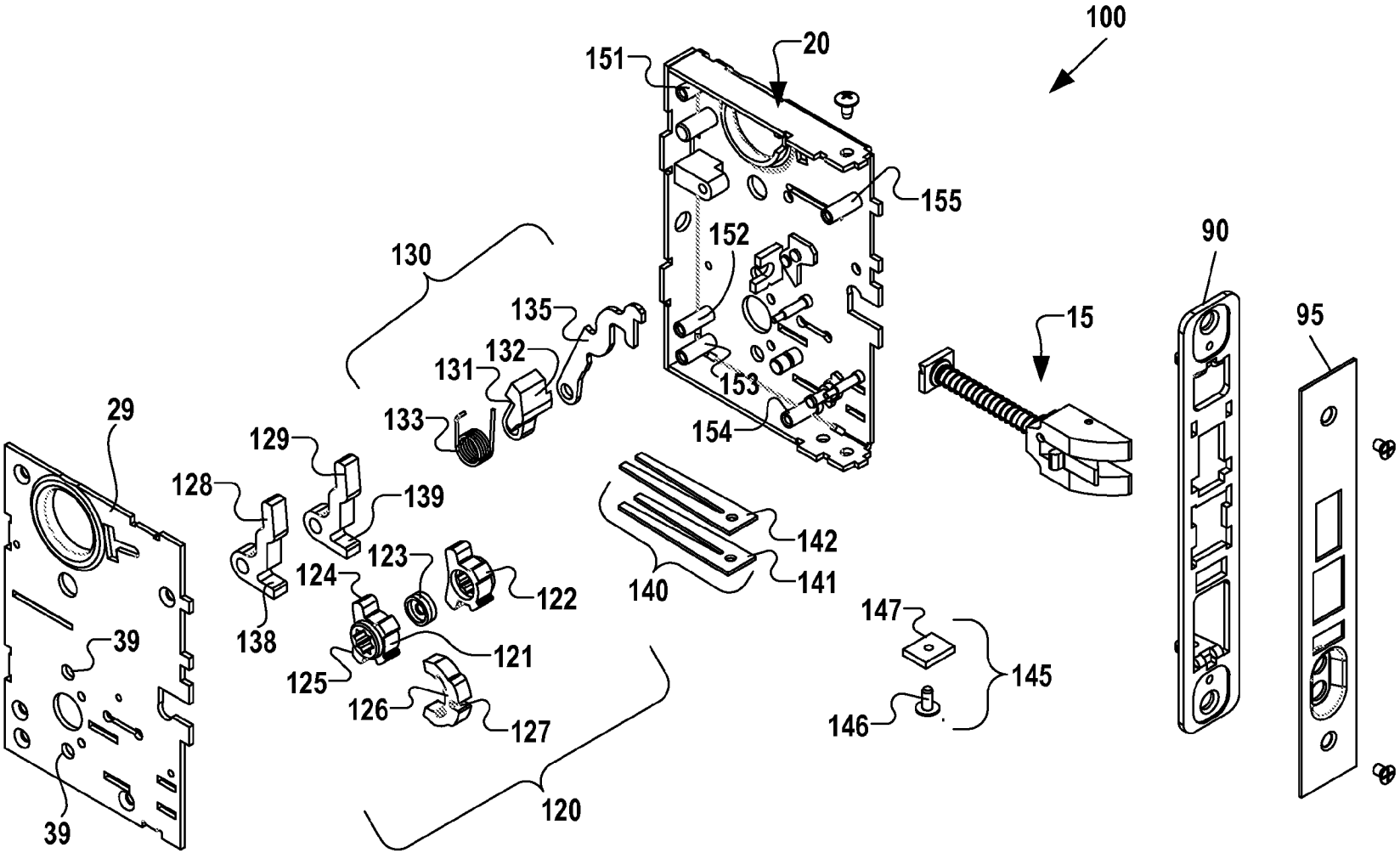
FIG. 13 is an exploded view diagram of the dual-cam mortise latchset of FIG. 4, with several components removed for clarity.
Figure 14:
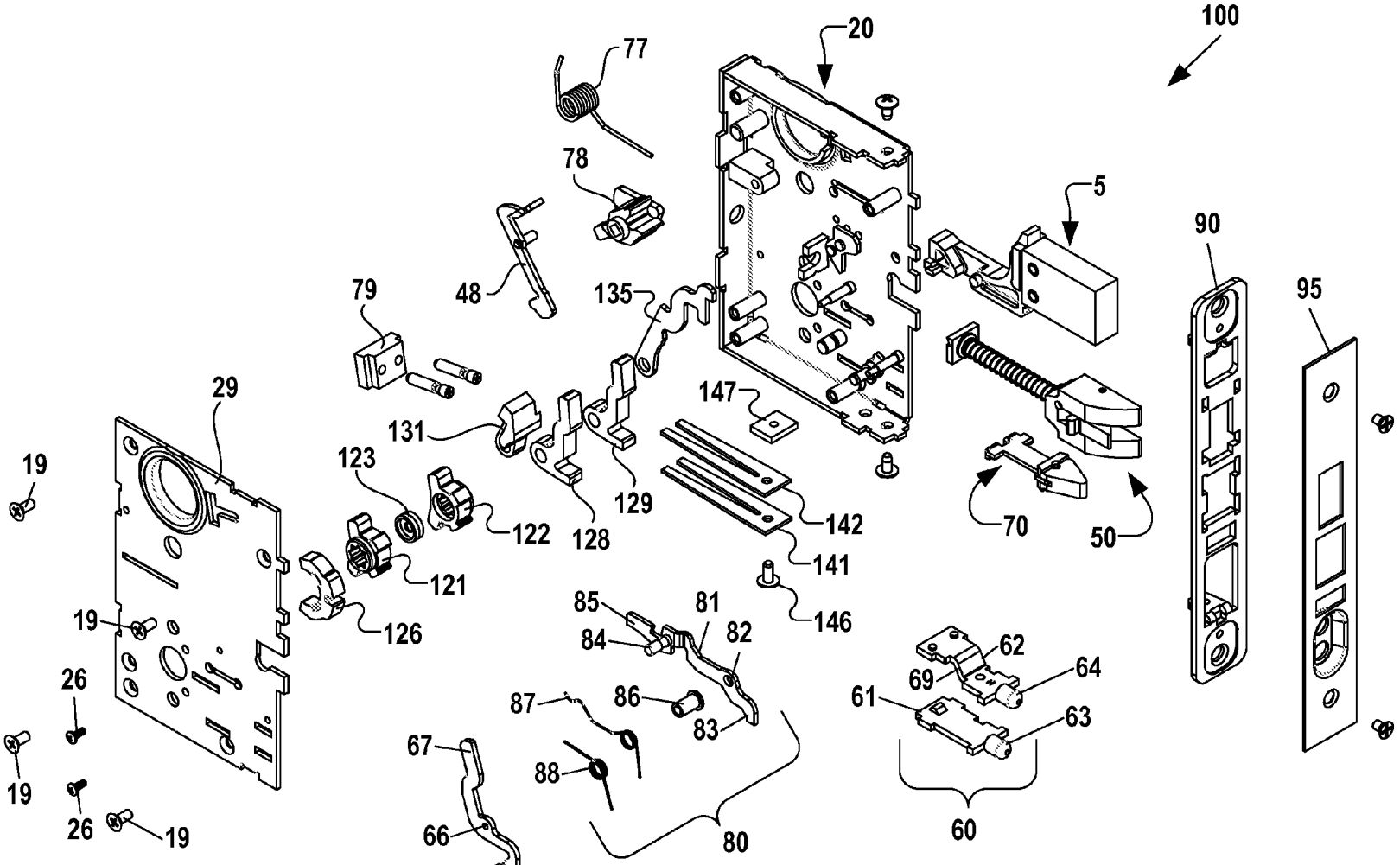
FIG. 14 is an exploded view diagram of the dual-cam mortise latchset of FIG. 5, showing most of the cooperating components in place.
Figure 15:
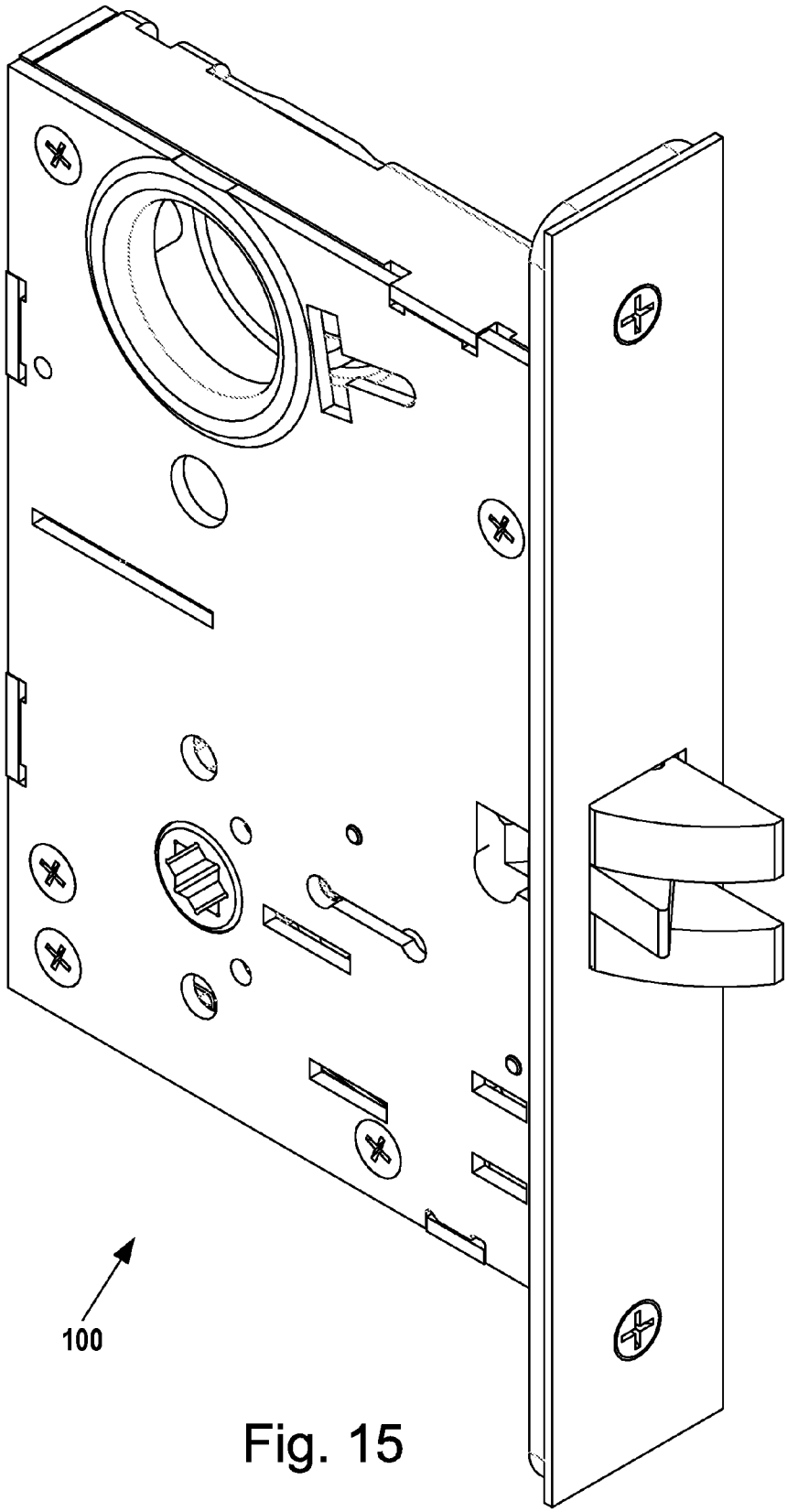
FIG. 15 is a perspective view of the dual-cam mortise latchset of FIG. 4, with the cover attached to the case.
Figure 16:
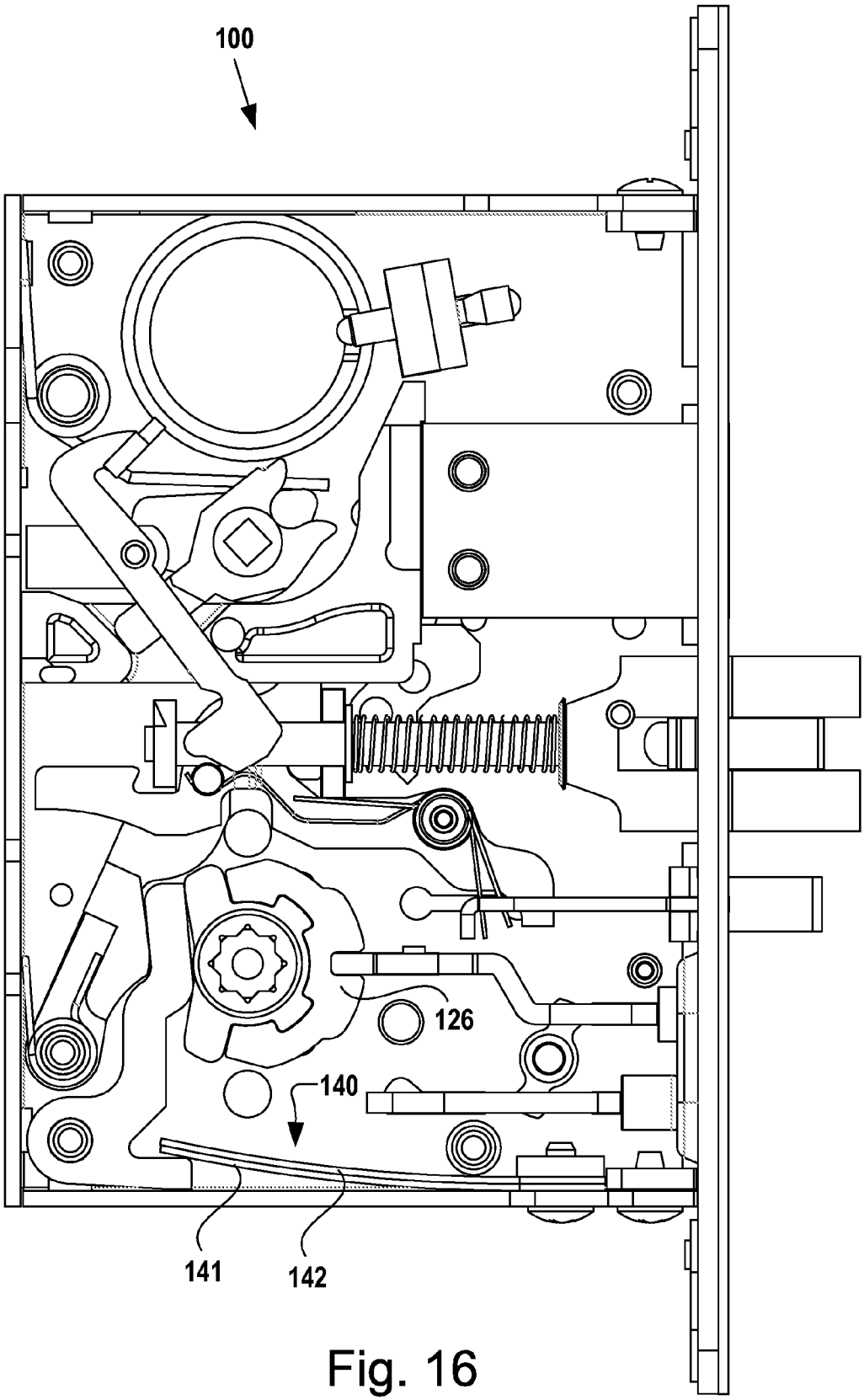
FIG. 16 is a partially cut-away side view of another embodiment of an improved biasing mechanism for a dual-cam mortise latchset, using two layered forked cantilevered springs for improved durability.
Figure 17:
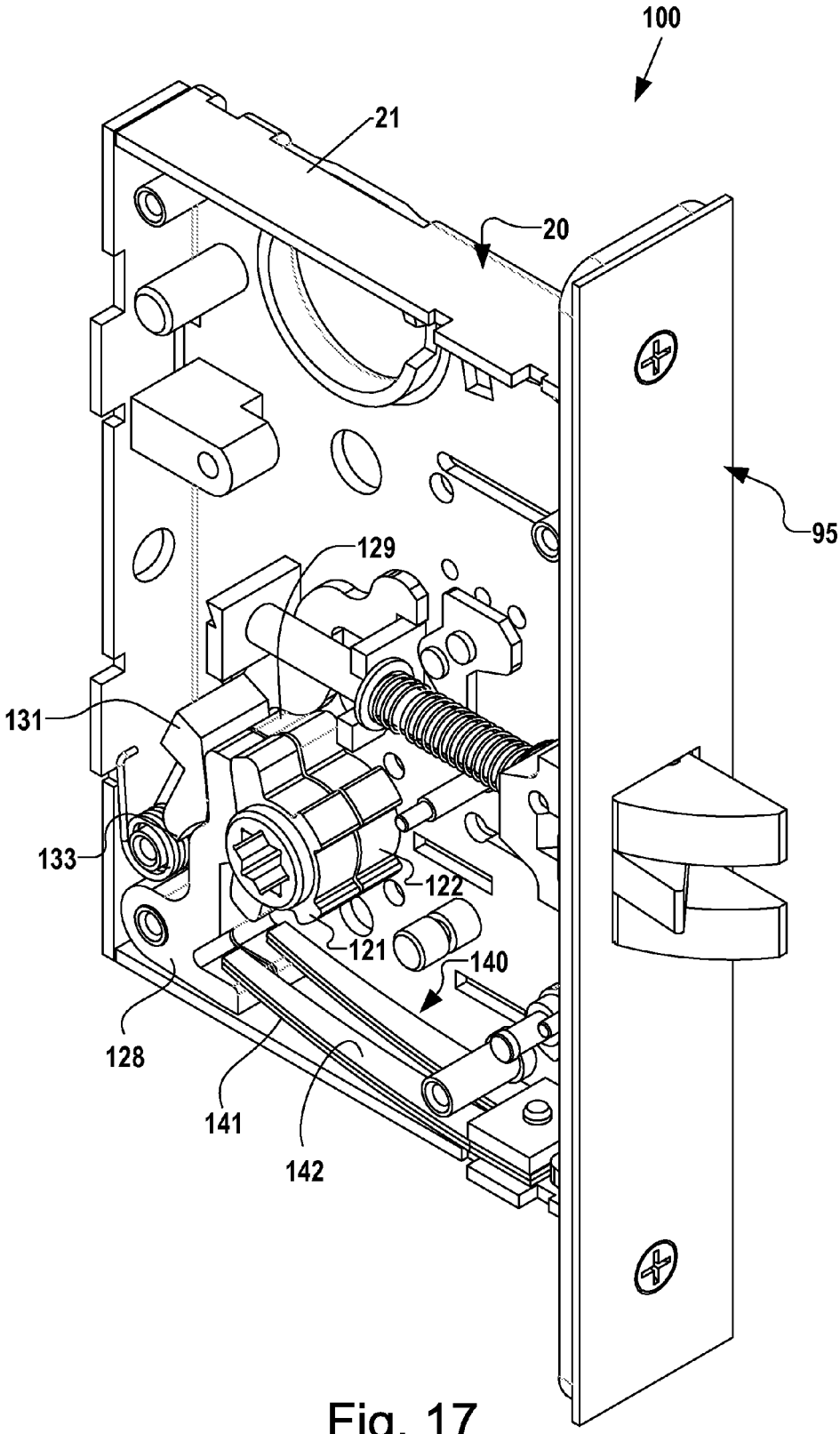
FIG. 17 is a perspective view of the dual-cam mortise latchset of FIG. 16.

FIGS. 4-12 illustrate the relative orientations of the operating cams 121 and 122 and cam followers 128 and 129 under different operating conditions. FIGS. 4-6 illustrate the mortise latchset 100 when both of the cams 121 and 122 are in their default, intermediate, handle-centering, non-latch-retracting positions. FIGS. 7 and 8 illustrate the mortise latchset 100 when the cover-side lever is rotated down. FIGS. 9 and 10 illustrate the mortise latchset 100 when the cover-side lever is rotated up. In both cases (FIGS. 7-10), the case-side cam continues to be biased by spring assembly 140 and cam follower 122 into its default, intermediate, handle-centering position. FIG. 11 illustrates the mortise latchset 100 when its case-side lever is rotated up, and FIG. 11 illustrates the mortise latchset 100 when its case-side lever is rotated down. In both cases (FIGS. 11 and 12), the cover-side cam continues to be biased by spring assembly 140 and cam follower 121 into its default, intermediate, handle-centering position FIGS. 13-17 illustrate another embodiment of an improved biasing mechanism for the dual-cam mortise latchset 100, using two layered forked cantilevered springs 141 and 142 for improved durability. The springs are stiff, flat, and made of 1095 high carbon spring steel. Each spring 141 and 142 is preferably about $1/20^{th}$ of an inch thick.

It will be noted that FIGS. 6, 8, and 10-12 depict a simplified faceplate 95. This is because the invention covers, and is suitable for, both mortise locksets with, and mortise passage door latchsets without, a deadbolt assembly 14, stop works assembly 60, guardbolt assembly 70, blocker assembly 80, or keyed cylinder assembly 98. It will also be noted that this specification substitutes conventional industry references to "mortise lock" or "mortise lockset" with the more abstract term "mortise latchset" in order to emphasize the invention's applicability to both locking and non-locking mortise locksets.

Having thus described exemplary embodiments of the present invention, it should be noted that the disclosures contained in FIGS. 1-17 are exemplary only, and that various other alternatives, adaptations, and modifications may be made within the scope of the present invention. Accordingly, the present invention is not limited to the specific embodiments illustrated herein, but is limited only by the following claims.

I claim:

1. A mortise latchset comprising:

a case assembly and cover;

inner and outer operating cams journaled in the case assembly and cover for independent coaxial movement relative to each other;

a pair of coaxially-mounted, independently leveraged cam followers mounted in the case assembly, one of the cam followers being mounted for engagement with one or more cam operating surfaces of the inner operating cam, and the other of the cam followers being mounted for engagement with the outer operating cam;

a retractable latchbolt supported in the case for movement between projected and retracted positions; and a latch retractor assembly operable to retract the latchbolt, wherein each of the cam followers is operable to drive the latch retractor assembly into a latchbolt-retracting position.

2. The mortise latchset of claim 1, wherein each of the cam followers is independently spring-biased to bias its corresponding operating cam into a handle-centering position.

3. The mortise latchset of claim 2, wherein the cam followers are spring-biased by at least one flat cantilevered spring.

4. The mortise latchset of claim 2, further comprising a biasing spring to bias the latch retractor assembly to press both cam followers towards their corresponding operating cams.

5. The mortise latchset of claim 1, wherein each of the cam followers is spring-biased by different prongs of a common forked cantilevered spring.

6. The mortise latchset of claim 1, wherein the operating cams are operable to be rotated in either clockwise or counterclockwise directions from a handle-centering position to engage the latch retractor assembly to retract the latchbolt, whereby rotation of the inside and outside door handles in either direction is operable to rotate the cams.

7. The mortise latchset of claim 6, further comprising angularly displaced divaricate cam projections on each of the operating cams, the divaricate cam projections being operable to engage the cam followers, and in turn the latch retractor assembly, to retract the latchbolt when the operating cam is rotated in either direction.

8. The mortise latchset of claim 1, wherein the mortise latchset is a reversibly handed lockset, the lockset further comprising a reversible locking slider operable to be selectably positioned over one or the other of the operating cams.

9. The mortise latchset of claim 1, further comprising two trim post holes located adjacent the operating cams, above and below the operating cams, at twelve and six o-clock positions, respectively.

10. A mortise latchset comprising:

a mortise latchset body housing a latchbolt;

inner and outer operating cams journaled inside the mortise latchset body for independent coaxial movement relative to each other;

wherein each of the operating cams is operable to rotate both clockwise and counterclockwise from an intermediate position to retract the latchbolt;

trim exterior to the mortise latchset body, including inside and outside door handles coupled to and operable to rotate the inner and outer operating cams both clockwise and counterclockwise from an intermediate, handle-centering position to retract the latchbolt; and a spring assembly housed inside the mortise latchset body operable to spring-load one of the handles while it is being rotated clockwise or counterclockwise, while still independently spring-loading the other of the handles to maintain it in the intermediate, handle-centering position;

wherein the spring assembly is capable of biasing the handles toward the intermediate, handle-centering position without any assistance from trim springs.

11. The mortise latchset of claim 10, wherein at least one of the inside and outside door handles is a lever-type handle that, in the intermediate position, extends preferentially to one side horizontally from and away from the handle's axis of rotation.

12. The mortise latchset of claim 10, wherein the spring assembly comprises at least one flat cantilevered spring.

13. The mortise latchset of claim 12, wherein the spring assembly comprises at least two flat cantilevered springs layered over each other.

14. The mortise latchset of claim 10, wherein the mortise latchset is a field-reversible lockset, the lockset further comprising a reversible locking slider operable to be selectably positioned over one or the other of the operating cams.

15. The mortise latchset of claim 10, further comprising two trim post holes located adjacent the operating cams, above and below the operating cams, at twelve and six o-clock positions, respectively.

16. A mortise latchset comprising:

a mortise latchset body housing a latchbolt;

inner and outer operating cams journaled inside the mortise latchset body for independent coaxial movement relative to each other;

wherein each of the operating cams is operable to rotate both clockwise and counterclockwise from an intermediate position to retract the latchbolt;

wherein each of the operating cams is configured to be coupled to a lever-type door handle in a manner that enables the door handle to rotate the operating cam both clockwise and counterclockwise from an intermediate position to retract the latchbolt; and a spring assembly housed inside the mortise latchset body that biases each operating cam toward the intermediate position, independent of the rotational position of the opposite cam;

wherein the spring assembly is capable of biasing each handle toward its intermediate, default handle-centering position, regardless of the rotational position of the opposite handle, and without any assistance from springs housed within the trim.

17. The mortise latchset of claim 16, wherein the spring assembly comprises at least one flat cantilevered spring.

18. The mortise latchset of claim 17, wherein the spring assembly comprises at least two flat cantilevered springs layered over each other.

19. The mortise latchset of claim 16, wherein the mortise latchset is a reversibly handed lockset, the lockset further comprising a reversible locking slider operable to be selectably positioned over one or the other of the operating cams.

20. The mortise latchset of claim 16, further comprising two trim post holes located adjacent the operating cams, above and below the operating cams, at twelve and six o-clock positions, respectively.

* * * * *